US006203069B1

(12) United States Patent
Outwater et al.

(10) Patent No.: US 6,203,069 B1
(45) Date of Patent: Mar. 20, 2001

(54) LABEL HAVING AN INVISIBLE BAR CODE APPLIED THEREON

(75) Inventors: Chris Outwater, Santa Barbara; Robert Loop, Westlake Village, both of CA (US)

(73) Assignee: DNA Technologies Inc., Los Angeles, CA (US)

( * ) Notice: Subject to any disclaimer, the term of this patent is extended or adjusted under 35 U.S.C. 154(b) by 0 days.

(21) Appl. No.: 09/419,252

(22) Filed: Oct. 15, 1999

Related U.S. Application Data

(63) Continuation-in-part of application No. 09/291,365, filed on Apr. 14, 1999.

(60) Provisional application No. 60/108,956, filed on Nov. 18, 1998.

(51) Int. Cl.[7] ..... B42D 15/00

(52) U.S. Cl. ..... 283/88; 283/89; 283/81; 283/91

(58) Field of Search ..... 283/67, 70, 72, 283/74, 80, 81, 79, 86, 87, 88, 89, 91, 94, 110, 114, 113, 901, 902

(56) References Cited

U.S. PATENT DOCUMENTS

| | | | | |
|---|---|---|---|---|
| 3,640,009 | * | 2/1972 | Komiyama | 283/88 |
| 4,222,662 | * | 9/1980 | Kruegle | 283/109 |
| 4,889,365 | * | 12/1989 | Chominard | 283/88 X |
| 5,522,623 | * | 6/1996 | Soules | 283/88 X |
| 5,856,048 | * | 1/1999 | Tahara et al. | 283/85 X |
| 6,076,859 | * | 6/2000 | Hall et al. | 283/89 |

* cited by examiner

*Primary Examiner*—Willmon Fridie, Jr.
(74) *Attorney, Agent, or Firm*—Foley & Lardner

(57) ABSTRACT

A product authentication system and method employs a unique mark that is simple and cost-effective to apply and read, but provides several layers of protection, including anti-counterfeit and anti-diversion, against counterfeiters. The unique mark includes a bar code that is printed in invisible ink comprising a UV or near-IR ink and an IR mark. The first layer of protection is invisibility. The second layer of protection is the bar code itself. The third layer of protection is the presence of the IR mark in the unique mark. The fourth layer of protection is the IR emitting characteristics of the IR mark.

7 Claims, 4 Drawing Sheets

LABEL HAVING AN INVISIBLE BAR CODE APPLIED THEREON

REFERENCE TO CO-PENDING APPLICATION

This application is a continuation-in-part of U.S. patent application Ser. No. 09/291,365, filed Apr. 14, 1999, which claims the benefit of U.S. Provisional Application No. 60/108,956, filed Nov. 18, 1998.

BACKGROUND OF THE INVENTION

1. Field of the Invention

The invention relates generally to a product authentication system and method and, more particularly, a product authentication system and method in which an authentication or security mark comprising a code that is not visible under visible light is applied on a label.

2. Description of the Related Art

Various techniques have been used to identify articles in an effort to reduce counterfeiting. For collectibles such as art works and sports memorabilia, where a single item may be worth millions of dollars, a technique that is highly refined and virtually impossible to copy is desired. This is because high potential counterfeiting gains will motivate counterfeiters to invest large sums of money and resources to defeat the anti-counterfeit measure. Similarly, the high cost of implementing an anticounterfeit measure for collectibles is typically accepted by the owner or insurer, because the potential loss from counterfeiting is great.

On the other hand, for mass produced items such as apparel, CDs, and audio and video cassettes, cost is a more important factor in implementing an anti-counterfeit measure. The implementation cost must be small enough so that the cost of the protected product will not increase dramatically. Yet, the anti-counterfeit measure must be refined enough so that counterfeiters will be unable to defeat the anti-counterfeit measure in a sufficiently easy manner such that they will be able to economically produce and sell counterfeit goods.

Mass produced items also have to be protected against product diversion. Product diversion occurs when a counterfeiter acquires genuine, non-counterfeit goods that are targeted for one market and sells them in a different market. The counterfeiter does this to circumvent the manufacturer's goal of controlling the supply of his or her goods in a particular market and, as a consequence, benefits from the sales in that limited supply market or in the diverted sales market.

In one type of anti-counterfeit and anti-diversion measure, an ultraviolet (UV) ink is used to mark the product with an identifying indicia. One benefit of using the UV ink is that it is typically not visible when illuminated with light in the visible spectrum (380–770 nm), but is visible when illuminated with light in the UV spectrum (200–380 nm). Therefore, counterfeiters will be unable to tell whether the product contains a security mark by merely looking at the product when the product is illuminated with visible light.

A number of UV inks are readily available in the security industry and can be obtained at a relatively low cost. Several UV ink types and compositions are described, for example, in U.S. Pat. No. 5,569,317, entitled "Fluorescent and Phosphorescent Tagged Ink for Indicia" the disclosure of which is incorporated by reference herein. This patent discloses a security mark that becomes visible when illuminated with UV light having a wavelength of 254 nm.

However, the use of security marks containing a UV ink has seen increased use and counterfeiters have become knowledgeable about their use. It has been a common practice for counterfeiters to examine the UV ink from a product sample, reproduce or procure the same or similar UV ink that matches the characteristics of the UV ink from the product sample, and apply the same security mark on the counterfeit products using the substitute UV ink.

In another type of anti-counterfeit and anti-diversion measure, an infrared (IR) ink is used to mark the product with an identifying indicia. As with the UV ink, one benefit of using the IR ink is that it is typically not visible when illuminated with light in the visible spectrum, but is visible when illuminated with light in the IR spectrum (800– 1600 nm). An additional benefit of using the IR ink is that it is more difficult to reproduce or procure the matching IR ink by studying a product sample containing the IR security mark. Examples of IR security mark usage are given in U.S. Pat. Nos. 5,611,958 and 5,766,324. The disclosures of these patents are incorporated by reference herein.

Widespread use of IR security marks have been limited, however, because of cost. Up-converting phosphors that are contained in IR inks are generally more expensive and less readily available than down-converting phosphors that are contained in many UV inks.

Biologic security marks have also been used to combat counterfeiting and product diversion, but their use have also been limited due to cost.

Combination security marks have also been proposed. In U.S. Pat. Nos. 5,360,628 and 5,360,628, the disclosures of both of which are incorporated by reference herein, a security mark comprising a visible component and an invisible component made up of a combination of a UV dye and a biologic marker, or a combination of an IR dye and a biologic marker is proposed. Also, in U.S. Pat. No. 5,698,397, the disclosure of which is incorporated by reference herein, a security mark containing two different types of up-converting phosphors is proposed.

SUMMARY OF THE INVENTION

An object of this invention is to provide a product authentication system and method employing a unique mark that is simple and cost-effective to apply and read, but provides several layers of protection against counterfeiters and includes anti-counterfeit and anti-diversion features. The unique mark according to the invention includes a bar code and is formed with an invisible ink. As used herein, "invisible" ink is ink that is not visible with the human eye when illuminated with light in the visible spectrum.

In the first and second embodiments of the invention, the invisible ink comprises an ultraviolet (UV) ink and an infrared (IR) ink. The UV or IR ink produces visible light when illuminated with a UV or IR light source, respectively.

In the third and fourth embodiments of the invention, the invisible ink comprises an IR ink of two types. Both types of IR ink require an IR light source to become visible. The first type has very good sensitivity of fluorescence and is visible when illuminated with a diffuse IR light source, even when the IR ink is present in small quantities. By contrast, the second type is typically not visible when illuminated with a diffuse IR light source.

A first layer of protection provided by the unique mark according to the invention is invisibility. A second layer of protection is the product control code represented by the bar code. A third layer of protection is the presence of the IR ink as part of the unique mark. A fourth layer of protection is the IR emitting characteristics of the IR ink.

Another object of the invention is to provide a method of applying the invisible code in a manner that is simple and cost-effective. In one method, the code is applied to a label by thermal ribbon printing. In another method, the code is hot stamped onto a label to affix the code onto the label to be resistant against normal handling and usage of the product.

Still another object of the invention is to provide a method of validating a product containing a label with an authentication mark according to the invention. In this method, the label is illuminated by a diffuse UV or IR light source and the mark is automatically read. If the mark is present and determined to be valid, a concentrated IR light is aimed at a location that has been predefined in relation to the mark. The product is validated if, responsive to the IR light, a sparkle of a predetermined color is emitted at that location.

Additional objects, features and advantages of the invention will be set forth in the description of preferred embodiments which follows.

BRIEF DESCRIPTION OF THE DRAWINGS

The invention is described in detail herein with reference to the drawings in which.

The accompanying drawings, which are incorporated in and constitute a part of the specification, illustrate presently preferred exemplary embodiments of the invention, and, together with the general description given above and the detailed description of the preferred embodiments given below, serve to explain the principles of the invention.

DETAILED DESCRIPTION OF THE PREFERRED EMBODIMENTS

Figure 1:
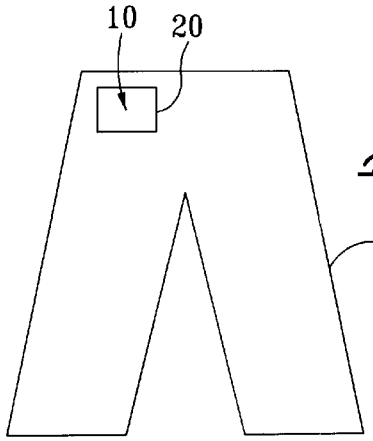
FIG. 1 illustrates a product containing a label with an authentication mark according to the invention.

FIG. 1 illustrates a label containing an authentication mark according to the invention. In the example of FIG. 1, the authentication mark 10 (not shown because it is invisible under normal light) is applied onto a label 20 that is affixed to a pair of pants 30. However, the authentication mark according to the invention is not limited to this example. The authentication mark according to the invention may be used to verify any product, and may be applied directly to a surface of the product or, as shown in the example, to the label 20. The label 20 may be either a product label or a care label. In general, application onto a care label is preferred because a care label typically has a uniform, usually white or light-colored, background onto which the mark is applied. By contrast, a product label is subject to the product logo design which may not have a uniform, light-colored background. A uniform, light-colored background is desired because it provides better contrast of the mark during reading of the mark. Further, in the preferred embodiments, the authentication mark 10 is applied to a polyester label. Other substrates, e.g., a nylon substrate or a cotton substrate, may be used.

Figure 2:
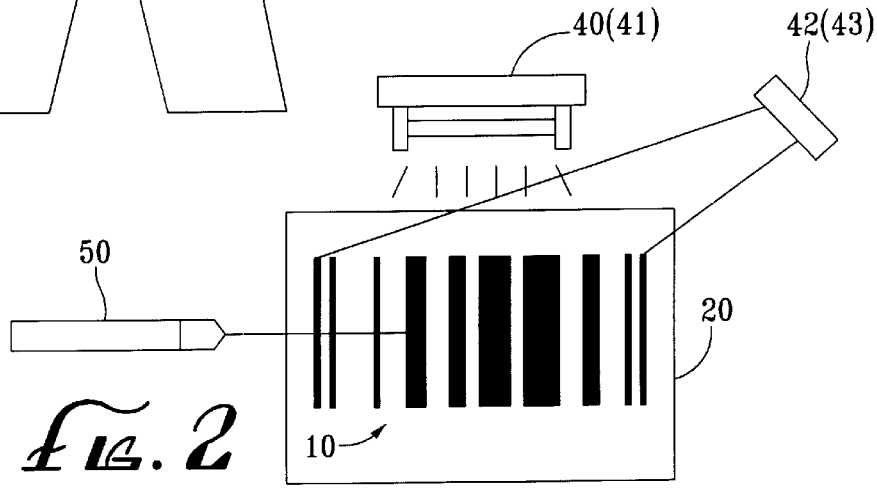
FIG. 2 is an enlarged view of the label having the authentication mark according to first and third embodiments of the invention.
Figure 3:
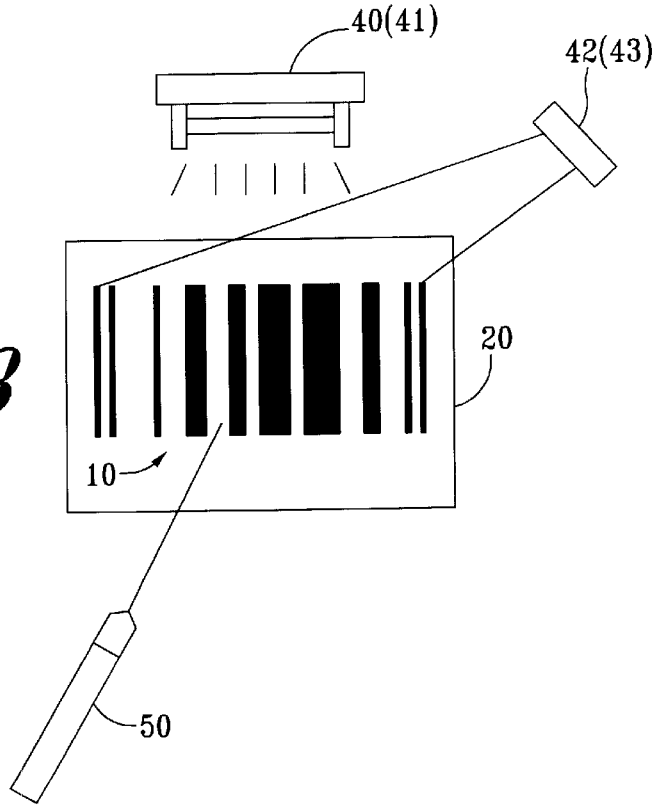
FIG. 3 is an enlarged view of the label having the authentication mark according to second and fourth embodiments of the invention.

The authentication mark 10 is invisible to the naked eye under normal lighting conditions. However, as shown in FIGS. 2 and 3, the mark 10, which comprises a bar code, becomes visible when placed under certain lighting conditions. In FIGS. 2 and 3, the entire bar code of the mark 10 becomes visible when placed under a diffuse ultraviolet (UV) light source 40 or a diffuse infrared (IR) light source 41. In both FIGS. 2 and 3, the illustrated bar code may represent, for example, a product control code that indicates the identity of the product and the intended market or destination of the product. The product control code is checked against the underlying product and its ultimate market or destination. If the former check is unsuccessful, the underlying product is deemed a counterfeit. If the latter check is unsuccessful, the underlying product is deemed to have been diverted.

In the first preferred embodiment, illustrated in FIG. 2, the bar code is formed with an ink containing a UV ink and an IR ink. The UV ink is used to initially locate the bar code with a diffuse UV light source 40. Once the bar code is located, it is automatically read using a UV bar code reader 42. The UV ink may be any common UV ink, for example, an ink containing an organic down-converting phosphor which emits light in the visible spectrum when exposed to UV light. Some UV inks are slightly visible in the visible light spectrum. This occurs because the visible light spectrum partially overlaps with the UV light spectrum. Thus, the UV ink is preferably selected so that it becomes visible only when it is exposed to UV light.

The IR ink contains an up-converting phosphor that becomes visible when excited by a concentrated IR light source 50. The IR light source 50 is aimed at any portion of the bar code made visible by the UV light, because the bar code is formed with an ink containing both the UV ink and the IR ink. The use of the IR ink, in addition to the UV ink, provides two additional layers of protection against counterfeiting. First, the use of the up-converting phosphor in conjunction with the UV ink may be unknown to a counterfeiter, and is likely to go undetected by the counterfeiter. Therefore, counterfeit products that contain just a code formed with the UV ink can be easily separated out from the genuine products having both the code formed with UV ink and the IR mark. Second, the color of the sparkle can be chosen by a selection of the up-converting phosphor. The up-converting phosphor that is selected for the present invention is an up-converting phosphor "PTIR545," which is available from Phosphor Technology Ltd. This up-converting phosphor emits a green sparkle when excited by a concentrated IR light source.

In the second embodiment, illustrated in FIG. 3, the bar code is formed with the UV ink and, in one or more spaces between the bars of the bar code, the IR ink is applied. As with the first embodiment, the UV ink is used to initially locate the bar code with the diffuse UV light source 40 and to read the bar code with the UV bar code reader 43. However, in the second embodiment, the IR light source 50 is not aimed at a portion of the bar code, but at a predetermined location between the bars of the bar code in which the IR ink was applied.

The third embodiment is also illustrated in FIG. 2, but the third embodiment differs from the first embodiment in three ways. First, the bar code is formed with an ink containing two types of IR inks. The first type of IR ink is a near-IR (700–1100 nm) ink containing a near-IR fluorophore invisible marker, known as ClirCode®, which is available from Eastman Chemical Company. This near-IR marker can be used at extremely low concentrations, on the order of parts per million (ppm) to parts per billion (ppb). Even at such low concentrations, it is visible under a diffuse IR light source, because of its extreme sensitivity of fluorescence. Second, a diffuse IR light source 41 is used in place of the UV light source 40 to initially locate the bar code. Third, an IR bar code reader 43 is used in place of the UV bar code reader 42 to automatically read the bar code.

In the fourth embodiment, also illustrated in FIG. 3, the bar code is formed with the near-IR ink and, in one or more spaces between the bars of the bar code, the IR ink is applied. As with the third embodiment, the near-IR ink is used to initially locate the bar code with the diffuse IR light source 41 and to read the bar code with the IR bar code reader 43. However, in the fourth embodiment, the IR light source 50 is not aimed at a portion of the bar code, but at a predetermined location between the bars of the bar code in which the IR ink was applied.

In the above described embodiments of the invention, because an up-converting phosphor, like PTIR545, is expensive, only small quantities are used to form the mark 10. For this reason, it is necessary that a concentrated laser source, like the IR laser source 50, be used as the IR light source when verifying whether the mark 10 contains the requisite IR mark. In the preferred embodiments, the IR laser source 50 has a power output of about 200 mW. The power requirement can be adjusted down, of course, if a greater amount of up-converting phosphor PTIR545 is used in the IR ink.

In the preferred embodiments, the bar code is either printed on the label 20 using a thermal ribbon printer or hot stamped onto the label 20. Thermal ribbon printing is preferred, because it can print more complex bar code formats, e.g., bar code 39. Hot stamping of the bar codes is, however, desired when the authentication mark 10 is required to withstand rigorous washing.

Figure 4:
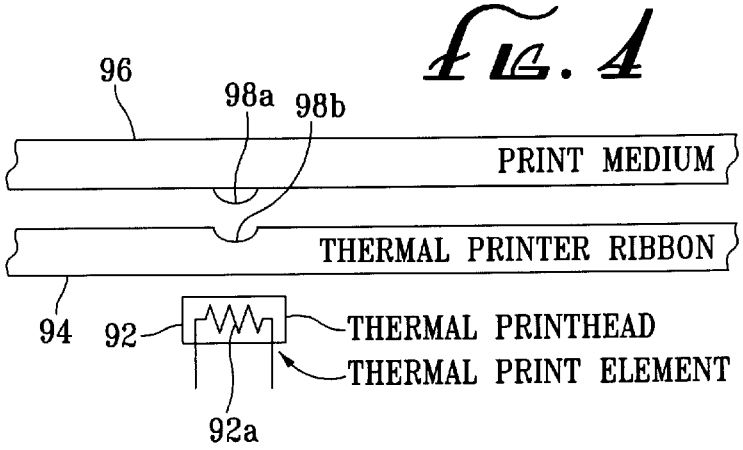
FIG. 4 schematically illustrates a thermal ribbon printing process used in the invention.

A thermal printer, a part of which is illustrated in FIG. 4, creates marks on a print medium by selectively heating elements within a thermal printhead 92 to cause the transfer of ink from a thermal printer ribbon 94 to the print medium 96. The thermal printhead 92 used for bar-code printing typically comprises an array of small thermal print elements 92*a*, each of which produces heat in response to an electrical input signal. The smallest element that can be printed, termed a pixel, is dependent on the size of the thermal print elements 92*a*. Each thermal print element 92*a* is typically a resistive strip of thermal material through which an electrical current is passed.

The invention employs a bar code thermal printer which has the thermal print elements 92*a* arranged in a linear array four to six inches wide with 800–1200 thermal print elements in a 1×800 or 1×1200 array. The thermal printhead 92 is stationary and a print medium 96 moves in a transverse direction past the thermal printhead 92. The print medium 96 is in thermal contact with the thermal print elements 92*a* as it is moved past the thermal printhead 2 in a stepwise fashion. During each step, desired thermal print elements 92*a* are selectively heated and portions of the print medium 96, e.g., care label, in thermal contact with the heated thermal print elements are printed with invisible ink transferred from a thermal printer ribbon 94. For example, FIG. 4 illustrates the transfer of a portion 98*a* of ink from the thermal printer ribbon 94 to the print medium 96. The thermal printer ribbon 94 shows a corresponding indentation 98*b* where the invisible ink from the thermal printer ribbon was transferred to the print medium 96.

The thermal printer ribbon 94 in the embodiment is polypropylene. It is prepared with the ink mixture using a photo gravure coating process. The ink mixture is prepared by mixing the UV and IR powders or near-IR and IR powders into a resin binder. The powders comprise 5–10% of the ink by weight, and the UV powder to IR powder ratio or near-IR powder to IR powder ratio is typically 7:3 by weight. The particle size of the UV, near-IR, and IR powders is about 1–5 microns.

Alternative to thermal ribbon printing, dot matrix printing may be used. The printer ribbon used in this method is prepared by saturating it with the ink mixture described above. In operation, the printer ribbon passes by a head that impacts the ribbon onto the label.

Figure 5:
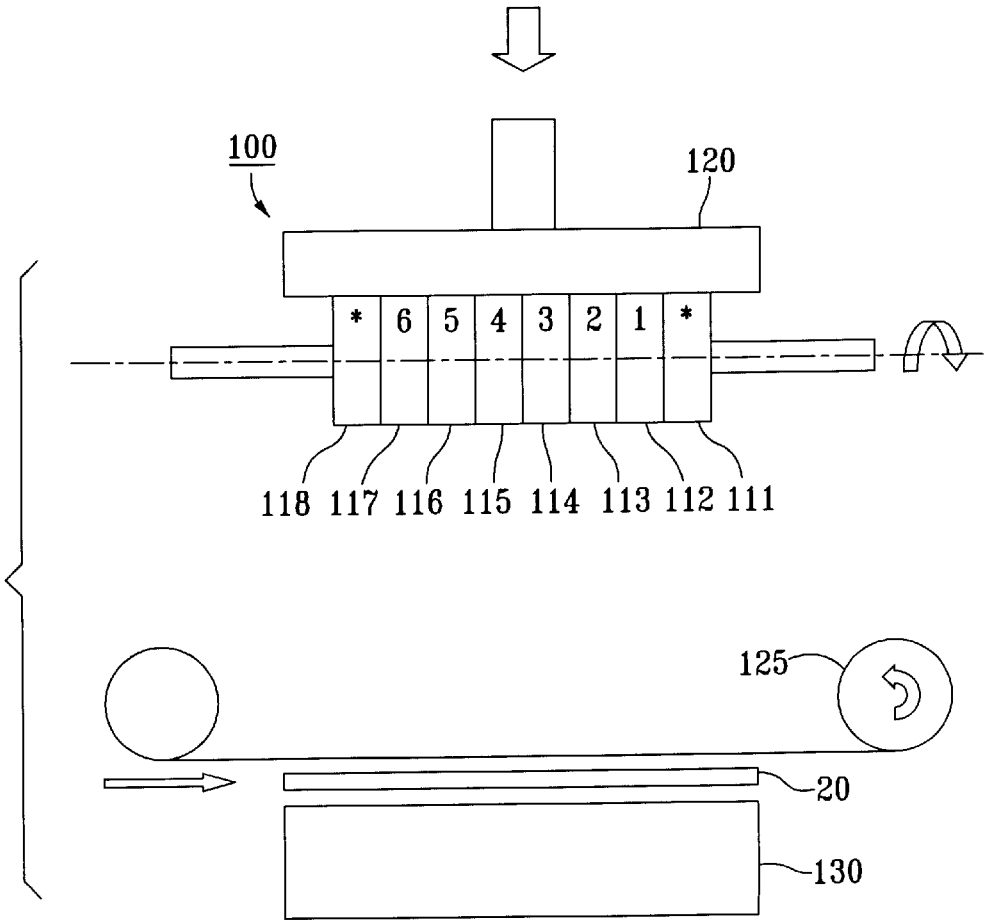
FIG. 5 schematically illustrates a hot stamping machine used in the invention.

The hot stamping process employs a hot stamping machine of FIG. 5. The hot stamping machine 100 has eight circular sections 111–118 which are depressed collectively by a press 120 against a plate 130 to stamp an image of a bar code on the label 20 using the ink that has been applied on the bottom side of a hot stamping foil 125. The two end sections 111, 118 stamp start and stop codes of the bar code. Each of the six middle sections 112–117 includes a wheel that is rotatable into one of four positions. In the first position, the wheel stamps nothing. In the second position, the wheel stamps a thin bar. In the third position, the wheel stamps a normal width bar. In the fourth position, the wheel stamps a thick bar. The six middle sections 112–117 are geared together so that when the section 112 completes one revolution, the section 113 is advanced by one rotary position, and when the section 113 completes one revolution, the section 114 is advanced by one rotary position, and so forth. In this manner, the stamping of different bar codes may be sequenced by a rotation of just the section 112. In all, a total of 4096 combinations are possible.

A shaft 140 runs through the center of all sections 111–118 but is connected to only the section 112. The shaft 140 is connected to a stepper motor (not shown) which rotates the section 112 by one rotary position via the shaft 140 for each pulse input it receives. Alternatively, the shaft 140 may be rotated by hand to cause the section 112 and subsequent sections 113–117 to rotate into any desired rotary position.

The hot stamping machine may be provided with lesser or greater number of sections, depending on the width of the label and the width of the bars and spaces of the bar code. The widths of the bars and spaces of the bar code may be reduced by improving the resolution of the bar code reader that is subsequently used to read the bar code.

When the authentication mark 10 is applied to a label of a pair of pants, it is desired that the application of the authentication mark 10 must be permanent enough to survive denim washing, stone washing, and enzyme washing that some types of pants, e.g., blue jeans, commonly undergo. To improve the durability of the authentication mark 10, a hot stamping process is used in the invention to form the authentication mark 10.

A conventional hot stamping process is well known and includes the steps of printing an image on a transfer paper by a silk screen printing process, using a hot stamp ink, and then transferring the image formed on the transfer paper onto a final carrier by a hot stamping machine at an appropriate temperature, pressure and time. The transfer ink used for this purpose is generally composed of a thermoplastic resin as a binder resin, such as vinyl chloride-vinyl acetate copolymers, acrylic resins and polyesters.

Figure 6:
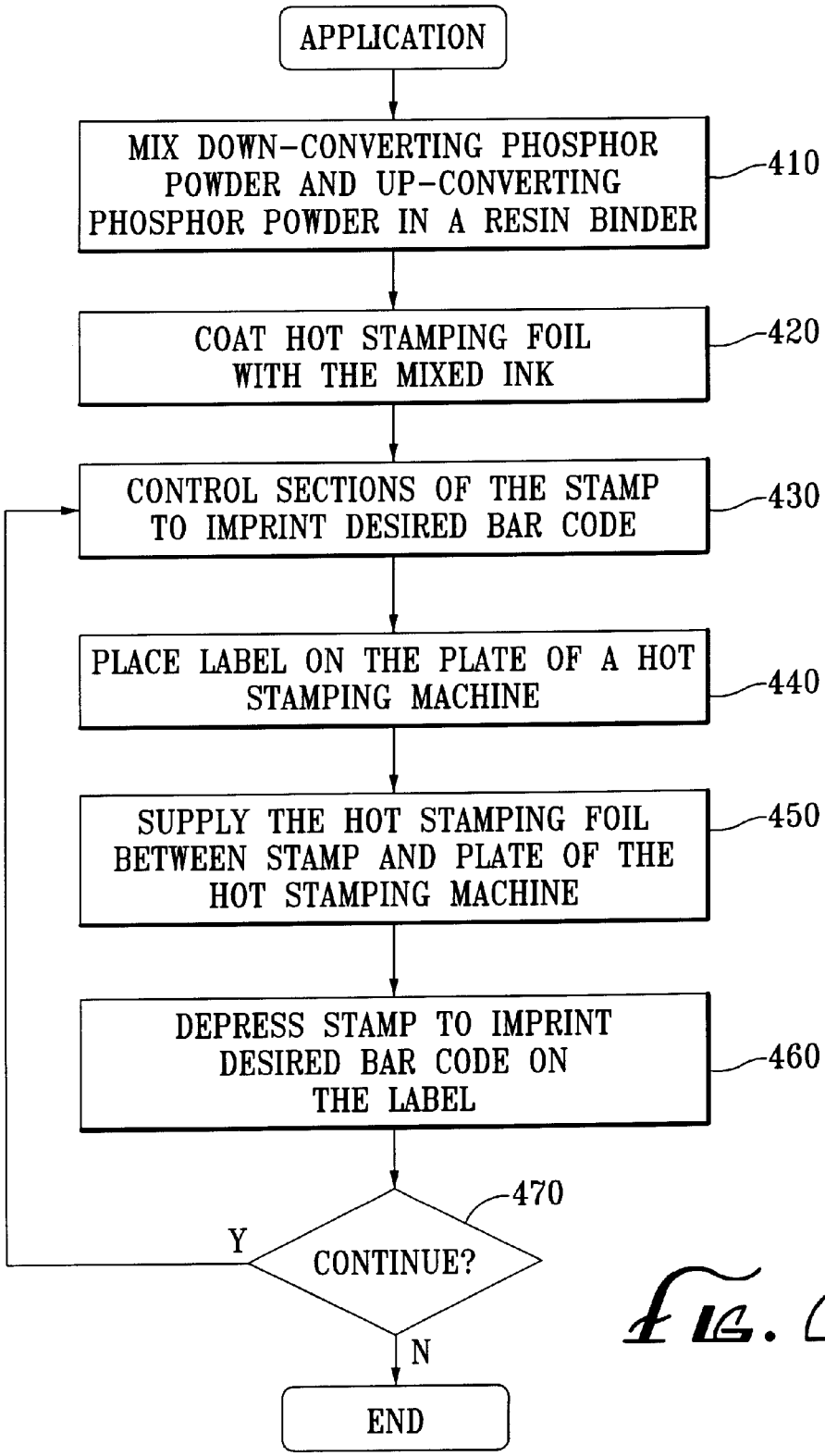
FIG. 6 illustrates the steps of applying the authentication mark according to the invention.

FIG. 6 illustrates the hot stamping process employed to produce the authentication mark according to the first preferred embodiment. In Step 410, a down-converting phosphor powder and an up-converting phosphor powder are mixed in a binder resin, which may be any acrylic or urethane resin that is thermoplastic, to form the ink for the authentication mark. The ratio of the down-converting phosphor powder to the up-converting phosphor powder that is used in the mixture is about 7:3 by weight, and the mixed phosphor powders comprise 10–20% by weight of the mixed ink. The preferred particle size of the phosphor powders is between 1–2 microns, but can be as large as 3 microns.

In Step 420, the authentication mark ink is coated onto a hot stamping foil, which can be plastic, mylar, polypropylene, or polyester. The coating process that is used in the present invention is commonly known as the Gravure process, but other types of rod coating or flexo-coating may be used.

The hot stamping machine 100 of FIG. 5 is used to hot stamp the bar code on to the label 20. The sequencing of the sections 112–117 to hot stamp a desired bar code onto the label 20 is carried out in Step 430. In Step 440, the label is placed on the plate 130 of the hot stamping machine, and in Step 450, the hot stamping foil is supplied between the stamp sections and the plate 130. The stamp sections are depressed in Step 460 and an imprint image is transferred onto the label 20 with the mixed ink. The hot stamping process is checked for completion in Step 470 and returns to Step 430 if the hot stamping process has not completed.

Alternative to the hot stamping process, an offset printing process may be used to apply the authentication mark 10 according to the invention. The offset printing process is also resistant to denim washing, but the hot stamping process is preferred because it provides a sequencing of the bar code. In offset printing, by contrast, the plates must be changed every time the bar code is changed.

The hot stamping process employed to produce the authentication mark according to the second preferred embodiment is carried out in a similar manner, with the following modifications. First, the down-converting phosphor powder and the up-converting phosphor powder are separately mixed with the resin binder to produce UV ink and IR ink, respectively. Second, the hot stamping foil is coated with the UV ink at predetermined areas to produce UV bands corresponding to the location of imprinting bars on the stamp and with the IR ink at predetermined areas to produce IR bands corresponding to the location of spaces between the imprinting bars on the stamp. Third, the stamp of the hot stamping machine 100 is modified to include additional sections in between the sections 111–118 for transferring the IR ink coated on the hot stamping foil onto one or more spaces between the bars of the bar code.

The hot stamping process employed to produce the authentication mark according to the third preferred embodiment is carried out in a similar manner to the first preferred embodiment, except that the up-converting phosphor powder is mixed with the near-IR fluorophore powder used in ClirCode®, instead of the down-converting phosphor powder, to form the authentication mark ink.

The hot stamping process employed to produce the authentication mark according to the fourth preferred embodiment is carried out in a similar manner to the third preferred embodiment, with the following modifications. First, the near-IR fluorophore powder and the up-converting phosphor powder are separately mixed with the resin binder to produce near-IR ink and IR ink, respectively. Second, the hot stamping foil is coated with the near-IR ink at predetermined areas to produce near-IR bands corresponding to the location of imprinting bars on the stamp and with the IR ink at predetermined areas to produce IR bands corresponding to the location of spaces between the imprinting bars on the stamp. Third, the stamp of the hot stamping machine 100 is modified to include additional sections between the sections 111–118 for transferring the IR ink coated on the hot stamping foil onto one or more spaces between the bars of the bar code.

Figure 7:
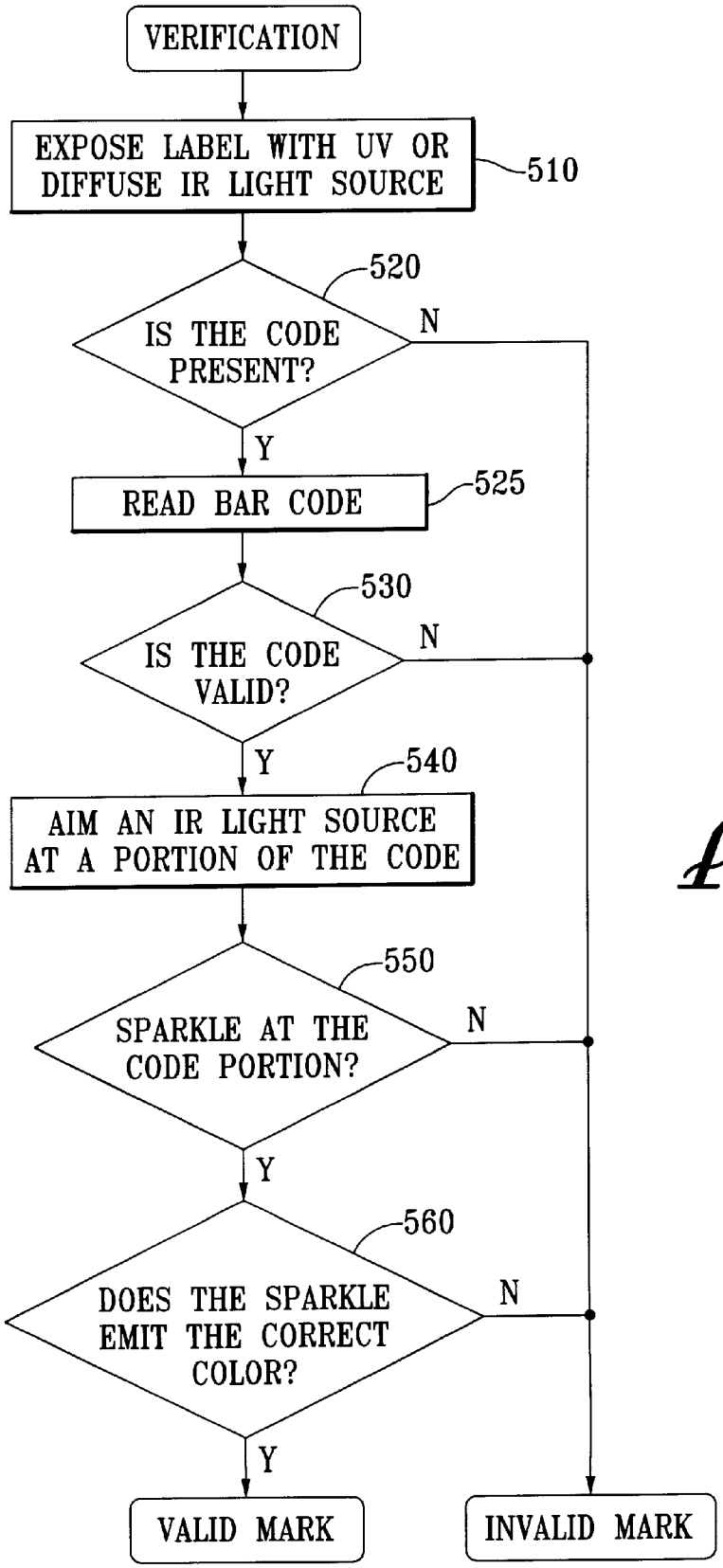
FIG. 7 illustrates the steps of identifying a product containing a label with the authentication mark according to the invention.

FIG. 7 illustrates the steps of identifying a product containing a label with the authentication mark according to the first preferred embodiment. In Step 510, a diffuse UV light source is turned ON to expose the label surface. Once the presence of a bar code is verified (Step 520), the bar code is read automatically by a UV bar code reader (Step 525) and checked to see if it is valid (Step 530). The bar code is present and invalid, e.g., if there is no record of it or if its product control code does not match the product's destination. If the bar code is valid, a focused IR laser light source is aimed at a portion of the bar code (Step 540). In Step 550, the emission of a sparkle is checked and in Step 560, the color of the sparkle is checked. If either the sparkle is not present or the color is incorrect, the examined product is deemed to be a counterfeit. Preferably, Steps 540 to 560 are performed on random product samples whose bar codes have been validated. These steps may be performed manually or automatically using an IR marker detector.

The process employed to identify the authentication mark according to the second preferred embodiment is carried out in a similar manner. The only difference is that the location for the IR mark is determined to be the spaces between the bars of the bar code, so the focused IR light source is aimed at these spaces, not at the bar code itself.

The process employed to identify the authentication mark according to the third preferred embodiment is carried out in a similar manner to the first preferred embodiment except that, in Step 510, a diffuse IR light source is used instead of a diffuse UV light source and an IR bar code reader is used instead of a UV bar code reader.

The process employed to identify the authentication mark according to the fourth preferred embodiment is carried out in a similar manner to the third preferred embodiment. The only difference is that the location for the IR mark is determined to be the spaces between the bars of the bar code, so the focused IR light source is aimed at these spaces, not at the bar code itself.

Another embodiment of the invention employs a plurality of different IR marks which emit one or more different visible colors when illuminated with a focused IR light source. The IR mark may be contained in the bar code, as in the first and third preferred embodiments, or not, as in the second and fourth preferred embodiments.

The invention is not limited to a one-dimensional bar code. The invention can be practiced with multi-dimensional bar codes and with bar codes formed with alternating concentric rings and spaces, as well as other shapes.

Furthermore, the printed bar code may be tied to a special weave or thread in the label. The special weave or thread may be a distinct thread color or a distinct weave pattern, a combination of the two, or a predetermined special location on the label for the distinct thread color and/or distinct weave pattern. This technique offers an additional level of security because, if the special weave or thread does not appear in the product label having the corresponding bar code printed thereon, the underlying product is determined to be a counterfeit.

While particular embodiments according to the invention have been illustrated and described above, it will be clear that the invention can take a variety of forms and embodiments within the scope of the appended claims.

We claim:

1. A label comprising an authentication mark having a bar code and an IR mark, wherein the bar code and the IR mark are not visible when illuminated under visible light, and wherein the bar code, but not the IR mark, is visible under a diffuse UV or IR light source.

2. The label according to claim 1, wherein the bar code is formed with a UV ink and the IR mark is formed with an IR ink that is visible under a focused beam of IR light.

3. The label according to claim 2, wherein the bar code includes bars and spaces and the IR mark is located in one or more of the spaces of the bar code.

4. The label according to claim 1, wherein the bar code is formed with a near-IR ink and the IR mark is formed with an IR ink that is visible under a focused beam of IR light.

5. The label according to claim 4, wherein the bar code includes bars and spaces and the IR mark is located in one or more of the spaces of the bar code.

6. The label according to claim 1, wherein the bar code and the IR mark are applied to the label using a hot stamping process.

7. The label according to claim 6, wherein the bar code comprises a product control code indicating an identity and destination of the underlying product.

* * * * *